US007832725B2

(12) United States Patent
Hosoya et al.

(10) Patent No.: US 7,832,725 B2
(45) Date of Patent: Nov. 16, 2010

(54) PAPER SHEET STACKING APPARATUS AND PAPER SHEET POST PROCESSING APPARATUS

(75) Inventors: Hisao Hosoya, Sagamihara (JP); Hiroto Ito, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 661 days.

(21) Appl. No.: 11/706,230

(22) Filed: Feb. 15, 2007

(65) Prior Publication Data

US 2007/0241495 A1 Oct. 18, 2007

(30) Foreign Application Priority Data

Apr. 14, 2006 (JP) ..... 2006-111675

(51) Int. Cl.
*B65H 31/00* (2006.01)

(52) U.S. Cl. ..... 271/213; 271/207; 271/220; 270/58.08; 270/58.12; 270/58.11

(58) Field of Classification Search ..... 271/220, 271/207, 213; 270/58.08, 58.12, 58.11, 37, 270/32; 414/789.7
See application file for complete search history.

(56) References Cited

U.S. PATENT DOCUMENTS 7,270,324 B2 * 9/2007 Ogata et al. ..... 271/220
7,413,181 B2 * 8/2008 Iida et al. ..... 270/58.12
2004/0080739 A1 * 4/2004 Sekiyama et al. ..... 355/407

FOREIGN PATENT DOCUMENTS

JP 2003-020154 1/2003

OTHER PUBLICATIONS

Japanese Office Action dated Apr. 4, 2008.

* cited by examiner

*Primary Examiner*—Saúl J Rodríguez
*Assistant Examiner*—Luis Gonzalez
(74) *Attorney, Agent, or Firm*—Finnegan, Henderson, Farabow, Garrett & Dunner, L.L.P.

(57) ABSTRACT

There is described a paper sheet post processing apparatus that includes a paper sheet stacking apparatus in which the paper sheet stacking operation can be smoothly and stably conducted during a high-speed post processing of paper sheets. The paper sheet stacking apparatus includes: a paper sheet stacking tray that is inclined with respect to a horizontal line; an ejecting member to press-push a lower end portion of the paper sheets stacked on the paper sheet stacking tray, so as to eject the paper sheets outside the paper sheet stacking apparatus; and a protrusion member to push up substantially a center portion of the paper sheets stacked on the paper sheet stacking tray. The protrusion member is formed as a separate member being independent of the ejecting member. Further, the height of the protrusion member is lower than that of the ejecting member.

14 Claims, 11 Drawing Sheets

FIG. 9 ( a )
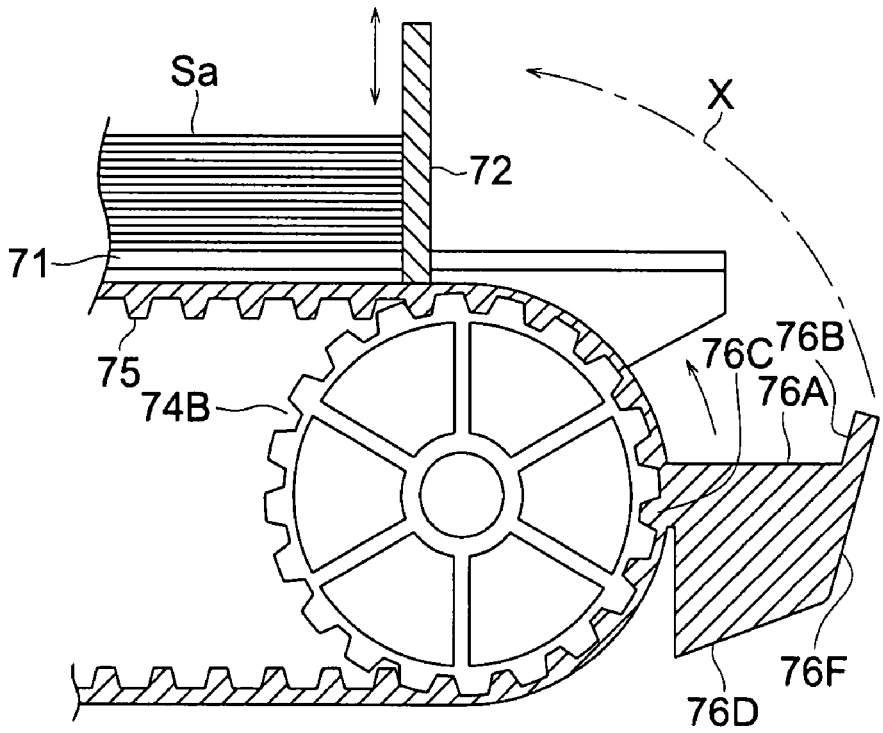
FIG. 9 ( b )
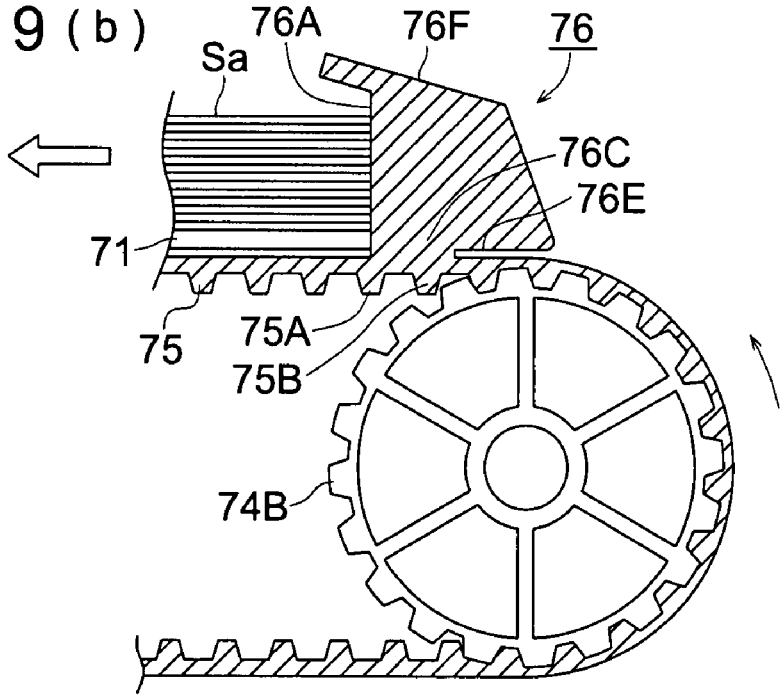

PAPER SHEET STACKING APPARATUS AND PAPER SHEET POST PROCESSING APPARATUS

This application is based on Japanese Patent Application No. 2006-111675 filed on Apr. 14, 2006 in Japanese Patent Office, the entire content of which is hereby incorporated by reference.

BACKGROUND OF THE INVENTION

The present invention relates to a paper sheet stacking apparatus and a paper sheet post processing apparatus that conducts paper sheet post processing operations after image forming operations are completed.

Recently, there has been proliferated in the market a paper sheet post processing apparatus that applies the post processing, such as a bind processing, etc., to a bunch of paper sheets including a plurality of paper sheets stacked on the paper sheet stacking tray mounted in an inclined state, as a peripheral apparatus to be combined with a high-speed image forming apparatus, such as an electro-photographic image forming apparatus.

Further, in order to minimize the size of the paper sheet post processing apparatus and to smoothly conduct the high-speed processing, there has been a tendency to increase the angle of inclination for mounting the paper sheet stacking tray.

In the paper sheet post processing apparatus provided with such the paper sheet stacking tray mounted in the inclined state, paper sheets stacked on the paper sheet stacking tray, are apt to float up. Accordingly, sometimes, a paper sheet, floating up from the tray, impedes conveyance of the following paper sheet, and therefore, it becomes impossible to smoothly conduct the conveying and stacking operations of the paper sheets.

Patent Document 1 (Tokkai 2003-20154, Japanese Non-Examined Patent Publication) sets forth a solution for preventing such the conveying and stacking failures, in which a floating up action of the upper end portion of the paper sheet is suppressed by raising a center portion of the paper sheet in a conveyance direction.

According to the Patent Document 1, by raising a center portion of the paper sheet, a floating up action of the upper end portion of the paper sheet is appropriately suppressed, and the paper sheet is smoothly introduced onto the paper sheet stacking tray.

According to the Patent Document 1, the ejection nail for ejecting the paper sheet is employed for raising the center portion of the paper sheet. In such the configuration, the ejection nail moves from the initial standby position to the push-up position at which the center portion of the paper sheet is pushed up, and when ejecting the paper sheet, further moves to the supporting position at which the ejection nail supports the lower end portion of the paper sheet.

Referring to FIG. 1, the movement of the ejection nail will be detailed in the following.

Since a standby position X2 of an ejection nail X1 is located in the vicinity of the lower end portion of a paper sheet stacking tray X3 and is far apart from a paper sheet push-up position X4, the moving distance of the ejection nail X1 for moving in the clockwise direction shown in FIG. 2 from the standby position X2 to the paper sheet push-up position X4 driven by a belt X5 becomes long, resulting in an increase of the moving time period. In addition, the time interval for moving in the anticlockwise direction from the paper sheet push-up position X4 and passing through the standby position X2 and arriving at the ejecting position at which ejection nail X1 contacts the lower end of the paper sheet also becomes long.

Accordingly, there has been a problem that the abovementioned configuration could not cope with the stacking operation of the paper sheets currently conveying at a high speed.

Further, in order to stack a lot of paper sheets, namely, about 100 paper sheets, onto the paper sheet stacking tray X3, the height of the ejection nail X1 should be set at a value more than 20 mm. However, when the height of the ejection nail X1 is increased, since the height of the protrusion of the paper sheets pushed up by the ejection nail X1 becomes too high, the introduction path of the paper sheet is narrowed, and, sometimes, it becomes impossible to smoothly introduce the paper sheet onto the paper sheet stacking tray X3.

SUMMARY OF THE INVENTION

According to an aspect of the present invention, the paper sheet stacking apparatus, comprises: a paper sheet stacking tray that is inclined with respect to a horizontal line; an ejecting member to press-push a lower end portion of a paper sheet stacked on the paper sheet stacking tray, so as to eject the paper sheet outside the paper sheet stacking apparatus; and a protrusion member to push up substantially a center portion of the paper sheet stacked on the paper sheet stacking tray; wherein the protrusion member is formed as a separate member being independent of the ejecting member.

According to another aspect of the present invention, the post processing apparatus, comprises: a paper sheet stacking apparatus that is provided with a paper sheet stacking tray that is inclined with respect to a horizontal line; and a binding processor to apply a bind processing to a bundle of paper sheets stacked on the paper sheet stacking tray; wherein the paper sheet stacking apparatus further includes: an ejecting member to press-push a lower end portion of a paper sheet stacked on the paper sheet stacking tray, so as to eject the paper sheet outside the paper sheet stacking apparatus; and a protrusion member to push up substantially a center portion of the paper sheet stacked on the paper sheet stacking tray; wherein the protrusion member is formed as a separate member being independent of the ejecting member.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 9(*a*) and FIG. 9(*b*) show partial cross sectional views for explaining an operation of an ejecting nail;

DETAILED DESCRIPTION OF THE PREFERRED EMBODIMENT

Figure 1:
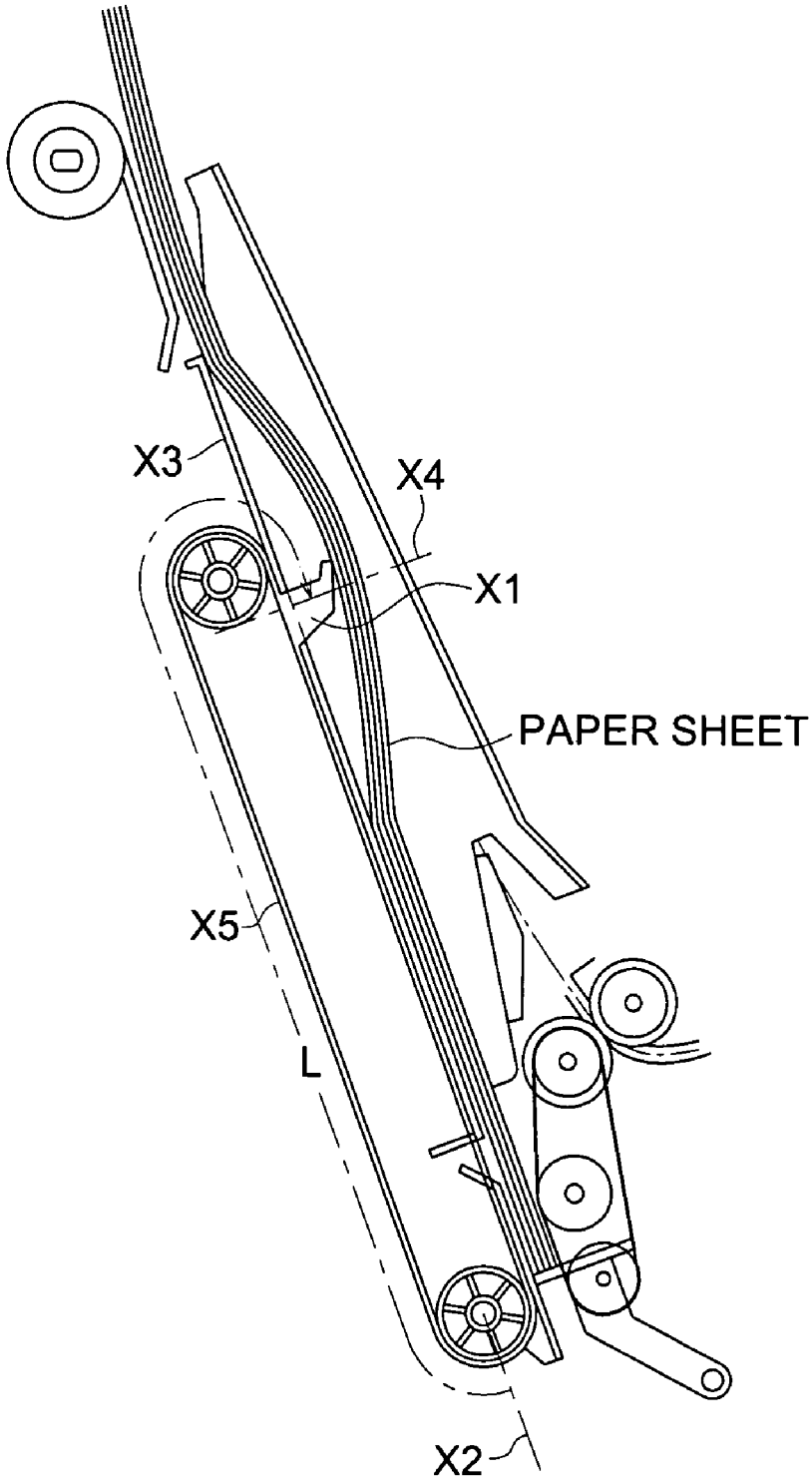
FIG. 1 PRIOR ART
FIG. 1 shows an explanatory drawing for explaining a movement of an ejection nail employed in a conventional paper sheet stacking tray.

Referring to the drawing, the embodiments of the present invention will be detailed in the following. However, the scope of the present invention is not limited to the embodiments described in the following.

<Image Forming Apparatus>

Figure 2:
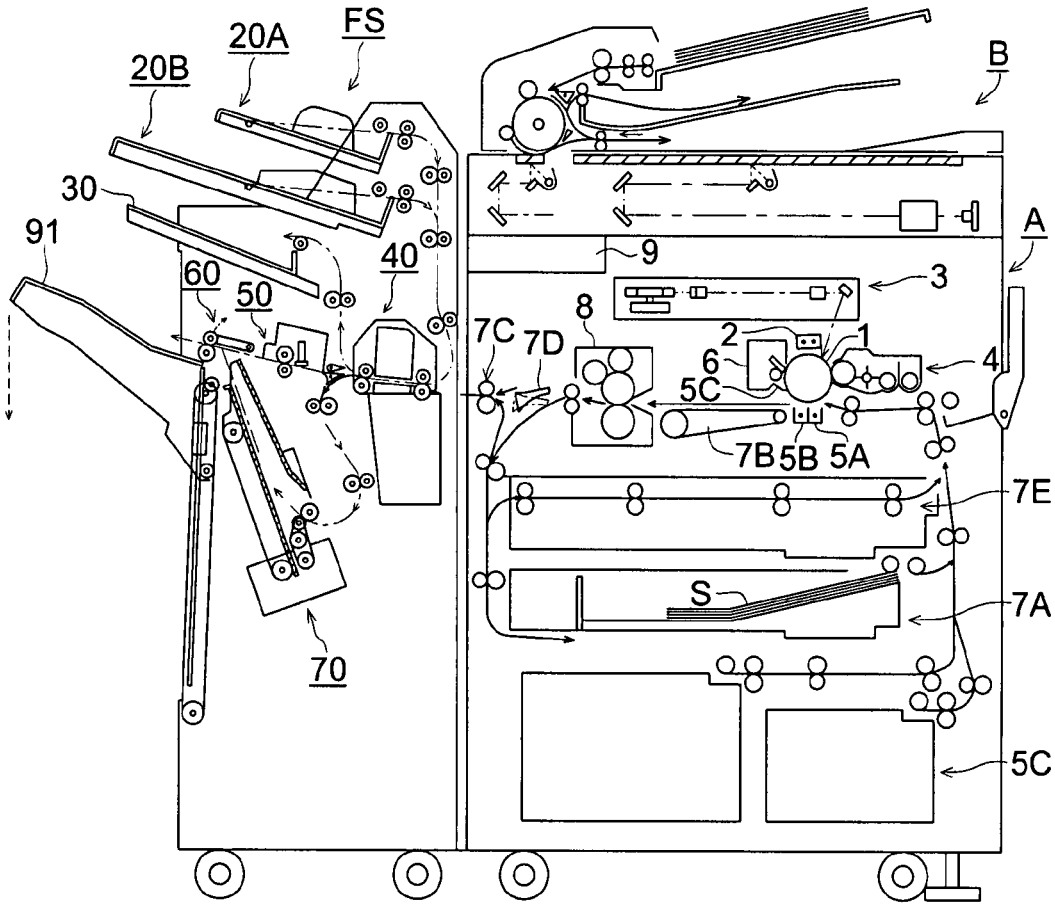
FIG. 2 shows a schematic diagram of an overall configuration of an image forming apparatus, provided with a paper sheet post processing apparatus embodied in the present invention.

FIG. 2 shows a schematic diagram of an overall configuration of an image forming apparatus, constituted by an image forming apparatus proper A, an image reading apparatus B and a paper sheet post processing apparatus FS.

The image forming apparatus proper A includes a photoreceptor drum 1 to be driven to rotate, and further includes a charging device 2, an image exposing device (image writing section) 3, a developing device 4, a transferring section 5A, a discharging section 5B, a separating nail 5C and a cleaning device 6, all of which are disposed at respective positions in the peripheral space around the circumferential surface of the photoreceptor drum 1. After the charging device 2 uniformly charges the circumferential surface of the photoreceptor drum 1, the image exposing device 3 exposes the photoreceptor drum 1 by scanning a laser beam modulated by the image data read from the original document so as to form a latent image on the photoreceptor drum 1. Then, the developing device 4 develops the latent image with toner in the reversal developing mode, to form a toner image on the circumferential surface of the photoreceptor drum 1.

On the other hand, a paper sheet S fed from a paper sheet accommodating section 7A is conveyed to the transfer position. At the transfer position, the transferring section 5A transfers the toner image formed on the photoreceptor drum 1 to the paper sheet S. After that, the discharging section 5B discharges the electric charges residing on the reverse surface of the paper sheet S, and the separating nail 5C separates the paper sheet S from the photoreceptor drum 1. Further, an intermediate transferring section 7B conveys the paper sheet S separated from the photoreceptor drum 1 to a fixing device 8 in which the toner image is fixed onto the paper sheet S by applying heat and pressure. The paper sheet S having a fixed toner image on it is ejected from an ejecting section 7C.

When conducting the duplex image-forming operation, the paper sheet S, on one side of which the toner image is already fixed by the fixing device, is branched from the normal ejecting path by a conveyance path switching plate 7D. Then, the paper sheet S enters into a reverse conveyance section 7E in which the paper sheet is turned over by the switchback operation, and is conveyed again through the transferring section 5A and the fixing device 8 to the ejecting section 7C from which the paper sheet is ejected outside the apparatus. The paper sheet S ejected form the ejecting section 7C is further conveyed into a paper sheet inlet section 11 of the paper sheet post processing apparatus FS.

On the other hand, after the transferring operation is completed, the residual developer particles remaining on the circumferential surface of the photoreceptor drum 1 are removed by the cleaning device 6 disposed downstream the separating nail 5C, so as to prepare for a next image forming operation.

An operation section 9, for selecting and setting an image forming mode and a paper sheet post processing mode, is disposed at a front-upper side of the image forming apparatus proper A.

The image reading apparatus B, provided with an automatic document feeder, is mounted on the upper section of the image forming apparatus proper A.

<Paper Sheet Post Processing Apparatus>

Figure 3:
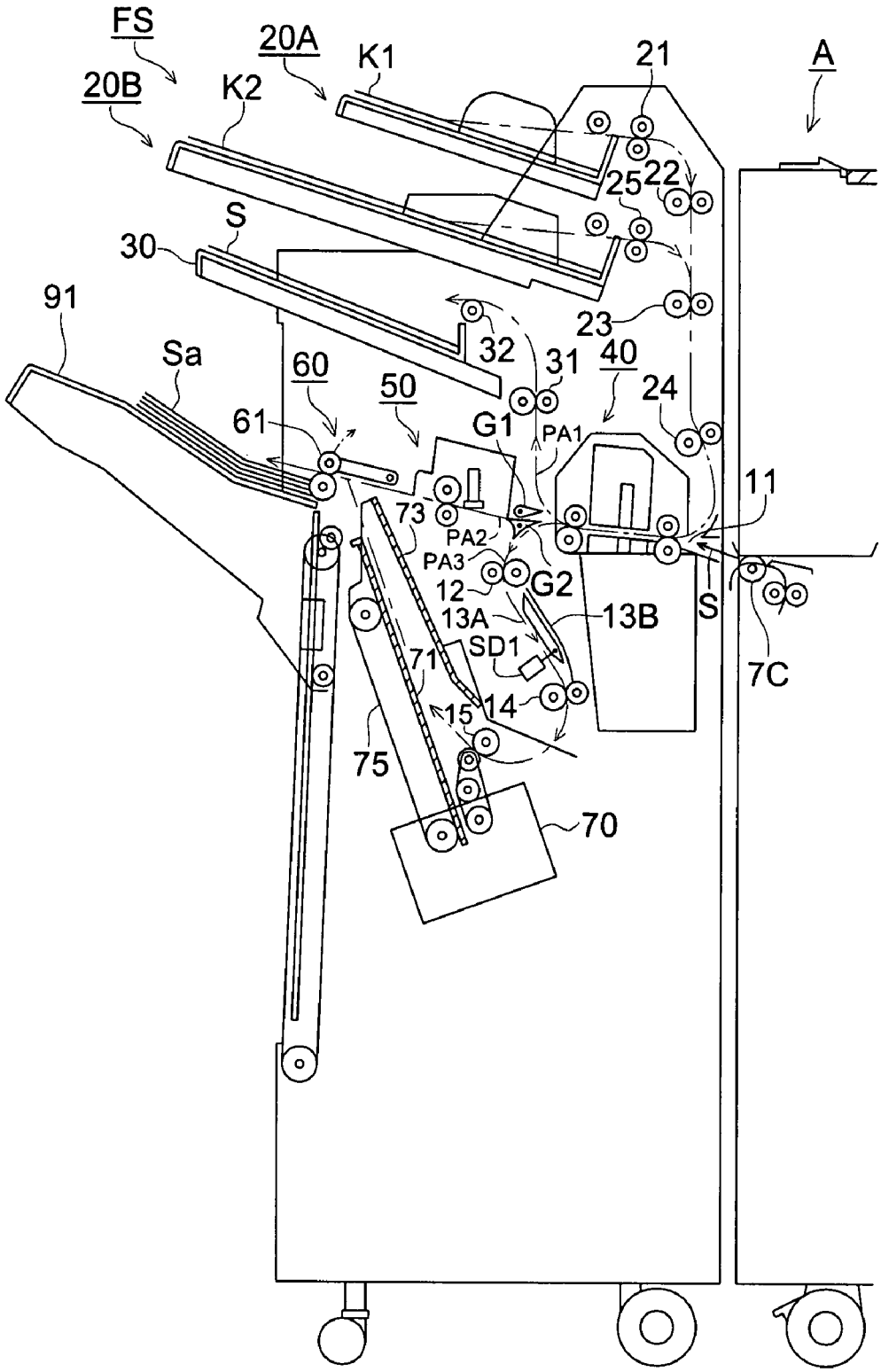
FIG. 3 shows a schematic diagram of an overall configuration of a paper sheet post processing apparatus embodied in the present invention.

FIG. 3 shows a schematic diagram of an overall configuration of the paper sheet post processing apparatus FS embodied in the present invention.

In the paper sheet post processing apparatus FS, as shown in FIG. 3, a first paper sheet feeding section 20A, a second paper sheet feeding section 20B and a fixed ejecting tray 30 are disposed at an upper stage section, and further, a punching processor 40, a shifting processor 50 and an ejecting section 60 are serially arranged substantially along a same horizontal plane located at a middle stage section, while a binding processor 70 is disposed at a lower stage section.

Further, an elevating ejection tray 91 for stacking the paper sheets S, for which the shift processing and/or the end bind processing are/is completed, is disposed at the left side of the paper sheet post processing apparatus FS shown in FIG. 3.

The paper sheet post processing apparatus FS is installed in such a manner that its position and height are adjusted so that the paper sheet inlet section 11 for accepting the paper sheet S conveyed out of the image forming apparatus proper A coincides with the ejecting section 7C of the image forming apparatus proper A.

Various kinds of paper sheets, including the paper sheet S image-processed and ejected from the image forming apparatus proper A, an inserting paper sheet K1, fed from the first paper sheet feeding section 20A, for dividing bunches of paper sheets from each other and a cover sheet K2 fed from the second paper sheet feeding section 20B, are introduced into the paper sheet inlet section 11.

#(Paper Sheet Feeding Section)

The inserting paper sheet K1, accommodated in a paper sheet feeding tray of the first paper sheet feeding section 20A, is picked up and conveyed by a paper sheet pick up section 21, and tightly clipped and conveyed by pairs of conveyance rollers 22, 23, 24 so as to introduce it to the paper sheet inlet section 11. Further, the cover sheet K2, accommodated in a paper sheet feeding tray of the second paper sheet feeding section 20B, is picked up and conveyed by a paper sheet pick up section 25, and tightly clipped and conveyed by the pairs of conveyance rollers 23, 24 so as to introduce it to the paper sheet inlet section 11.

#(Punching Processor)

The punching processor 40 is disposed at a downstream side of the paper sheet inlet section 11 in the paper sheet conveying direction. The punching processor 40 is provided with a movable puncher driven in both up and down directions and fixed dies into which cutting edges of the puncher fit.

#(Paper Sheet Branching Section)

A paper sheet branching section including switching members G1, G2 is disposed at a downstream side of the punching processor 40 in the paper sheet conveying direction. The switching members G1, G2, driven by the solenoids (not shown in the drawings), selectively branches the paper sheet conveyance path into any one of different paths of three directions, namely, a first conveyance path PA1 extended toward the upper stage ejecting tray, a second conveyance path PA2 equipped in the middle stage and a third conveyance path PA3 extended toward the lower stage.

#(Simple Ejecting Mode)

When the simple ejecting mode is established, the switching member G1 closes both the second conveyance path PA2 and the third conveyance path PA3, so as to open the first conveyance path PA1.

The paper sheet S is tightly clipped and conveyed upward through the first conveyance path PA1 by a pair of conveyance rollers 31, and is ejected onto the fixed ejecting tray 30 by an ejecting roller 32. Through the same process, a plurality of paper sheets S are sequentially stacked one by one onto the fixed ejecting tray 30. The maximum stacking capacity of the fixed ejecting tray 30 is 200 paper sheets.

#(Shirt Processing)

When the shift processing mode is established, the switching member G1 turns to an upward position and the switching member G2 closes the third conveyance path PA3. Accordingly, the second conveyance path PA2 is opened so as to introduce the paper sheet S into the second conveyance path PA2. The paper sheet S passes through the conveyance path formed between the switching members G1, G2.

The paper sheet S image-processed and ejected from the image forming apparatus proper A, the inserting paper sheet K1 fed from the first paper sheet feeding section 20A, or the cover sheet K2 fed from the second paper sheet feeding section 20B passes through the conveyance path formed between the switching members G1, G2, and is shifted at a predetermined value in a direction orthogonal to the paper sheet conveyance direction by the shifting processor 50, and is conveyed in an ejecting direction by a pair of conveyance rollers.

The shifting processor 50 conducts a shift processing for changing the ejecting position of the paper sheet S in a conveyance width direction for every predetermined number of paper sheets. A plurality of paper sheets S, to which the shift processing is applied, are sequentially stacked one by one onto a paper sheet ejecting elevation tray 91 by the ejecting section 60. The paper sheet ejecting elevation tray 91 is so constituted that, when a lot of paper sheets S are ejected, it sequentially descends step by step in accordance with a number of paper sheets S stacked. The maximum stacking capacity of the paper sheet ejecting elevation tray 91 is 3000 paper sheets (for A4 or B5 size).

Figure 4:
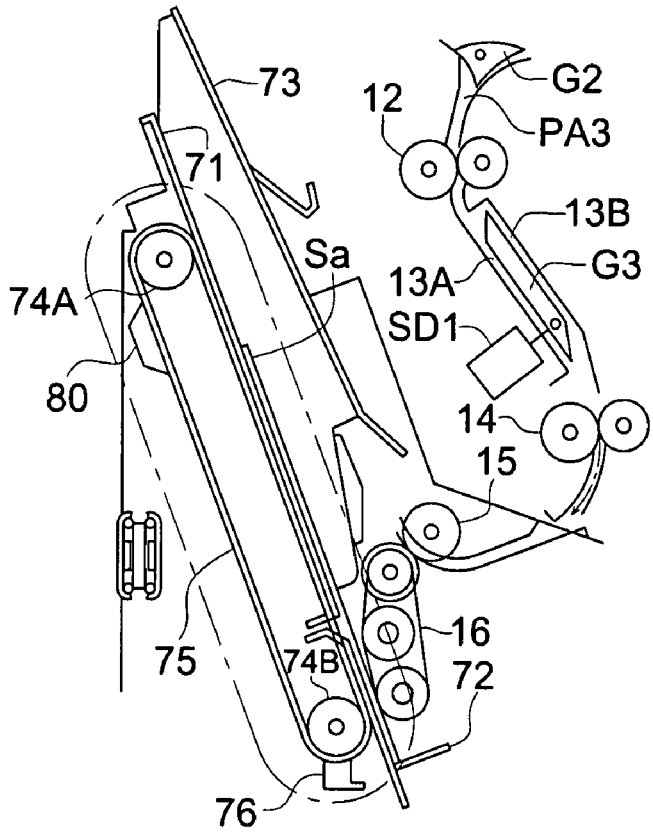
FIG. 4 shows a cross sectional view of a paper sheet stacking apparatus embodied in the present invention.

FIG. 4 shows a cross sectional view of a paper sheet stacking apparatus embodied in the present invention.

When the bind processing is established from the operation section 9 (shown in FIG. 2), the paper sheet S, for which the image forming operation is applied and finished in the image forming apparatus proper A and which is conveyed into the paper sheet inlet section 11, passes through the punching processor 40, and is fed into the third conveyance path PA3 located below the switching member G2, and is tightly clipped and conveyed toward the lower direction by a pair of conveyance rollers 12.

When the paper sheet S whose size is greater that A4 or B5 size is conveyed into the third conveyance path PA3, the paper sheet S passes through the paper sheet path 13A located at the left-side of a switching member G3 driven by a solenoid SD1 as shown in FIG. 4, and is tightly clipped and conveyed toward the lower direction by a pair of conveyance rollers 14. Successively, the paper sheet S is tightly clipped and conveyed by a pair of conveyance rollers 15 located further downstream, and ejected into an upper space of a paper sheet stacking tray 71 mounted in an inclined state, so that the paper sheet S is conveyed toward an inclined upper direction, while contacting the upper surface of the paper sheet stacking tray 71 or the upper surface of the paper sheet S stacked on the paper sheet stacking tray 71. After the trailing edge portion of the paper sheet S is completely ejected from the clipping position of the pair of conveyance rollers 15 in the paper sheet progressing direction, the paper sheet S begins to descend (slip down) on the inclined surface of the paper sheet stacking tray 71 due to its own weight, and after traveling on the inclined surface, the paper sheet S stops by butting its trailing edge against a paper sheet butting surface of a butting member 72 to be used for the end binding operation located in the vicinity of the binding processor 70. Numeral 16 indicates a wind up belt, which circulates and contacts the trailing edge portion of the paper sheet S so as to urge the paper sheet S toward the butting member 72.

As mentioned in the above, the paper sheet S slips down the upper surface of the paper sheet stacking tray 71 and stops by butting its trailing edge against a paper sheet butting surface of the butting member 72. In order to smoothly conduct the paper sheet stacking operation utilizing the slipping down action, it is preferable that the angle of inclination of the paper sheet stacking tray 71 versus the horizontal line is set at a value in a range of 50°-80°.

In order to effectively and continuously convey the small-sized paper sheet S, such as A4 size, B5 size, etc., into the third conveyance path PA3 so as to improve the productivity of copying operations, the switching member G3 being movable and a paper sheet path 13B, extended in parallel to the paper sheet path 13A located at the left side of the switching member G3 as shown in FIG. 4, are provided in the paper sheet post processing apparatus FS.

Driving the solenoid SD1 coupled to the switching member G3, the paper sheet path 13A is closed and the paper sheet path 13B is opened.

The first small-sized paper sheet S fed by the pair of conveyance rollers 12 passes through the paper sheet path 13B and stops by butting its leading edge against the circumferential surface of the pair of conveyance rollers 15, rotation of which is currently deactivated.

Successively, by deactivating the solenoid SD1, the leading edge portion of the switching member G3 turns clockwise, so as to close the paper sheet path 13B and to open the paper sheet path 13A. The second small-sized paper sheet S fed by the pair of conveyance rollers 12 passes through the paper sheet path 13A and stops by butting its leading edge against the circumferential surface of the pair of conveyance rollers 15, rotation of which is currently deactivated. Accordingly, the leading edge portions of the first small-sized paper sheet S and that of the second small-sized paper sheet S overlap with each other in the vicinity of the clipping position of the pair of conveyance rollers 15 and stop in a standby state.

Then, the pair of conveyance rollers 15 starts to rotate at a predetermined timing, so as to clip and convey the two paper sheets S simultaneously. The two paper sheets S are ejected onto the paper sheet stacking tray 71.

Numeral 73 indicates a pair of width truing members movably equipped upstream at both sides of the paper sheet stacking tray 71. The pair of width truing members 73 is movable in a direction orthogonal to the paper sheet conveying direction, and is opened wider than the width of the paper sheet, when accepting the paper sheet S conveyed onto the paper sheet stacking tray 71. At the time when the paper sheet S slipped down the paper sheet stacking tray 71 and stops by butting its trailing edge against the paper sheet butting surface of the butting member 72, the pair of width truing members 73 weakly butts the both side end potions of the paper sheet S in the width direction, so as to perform the width truing operation (width adjusting operation) for a bunch of paper sheets Sa. When a predetermined number of paper sheets S are stacked and trued on the paper sheet stacking tray 71 at this stopping position, the binding processor 70 applies a bind processing to the bunch of paper sheets Sa at the same stopping position, to bind the bunch of paper sheets Sa together.

A notch section is formed on a part of the paper sheet stacking surface of the paper sheet stacking tray 71, and an ejecting belt 75, which serves as an ejecting device and is threaded on a driving pulley 74A and a driven pulley 74B, is driven to circulate along the notch. An ejecting nail 76, serving as an ejecting member, is integrally formed on a part of the ejecting belt 75, in such a manner that the peak portion of the ejecting nail 76 depicts the ellipse locus according as the movement of the ejecting belt 75, as indicated by the alternate long and short dash lines shown in FIG. 4. After the bind processing is completed, the ejecting belt 75 is activated to circulate, so that the ejecting nail 76 pushes up the trailing edge portion of the bunch of paper sheets Sa. Then, the bunch of paper sheets Sa is pushed upward along the inclined upper direction while riding on the ejecting belt 75 and slipping on the stacking surface of the paper sheet stacking tray 71, so as to approach the clipping position of a pair of ejecting rollers 61 of the ejecting section 60. The bunch of paper sheets Sa is tightly clipped and is ejected onto the paper sheet ejecting elevation tray 91 by the pair of ejecting rollers 61 currently activated to rotate (refer to FIG. 3).

Numeral 80 indicates a protrusion member for raising substantially a center portion of the bunch of paper sheets Sa in the conveyance direction. The protrusion member 80 will be detailed later on.

Figure 5:
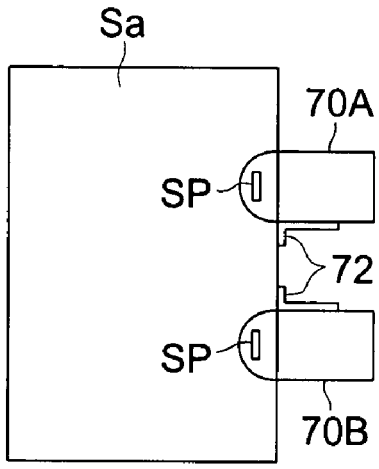
FIG. 5(*a*) and FIG. 5(*b*) show plan views of a bunch of paper sheets and a binding processor, indicating positional relationships between them when conducting various kinds of bind processing.
Figure 5:
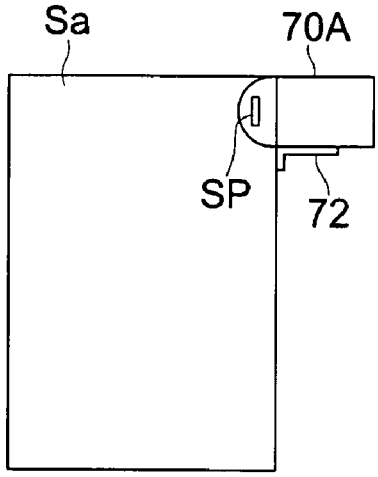

FIG. 5(*a*) and FIG. 5(*b*) show plan views of the bunch of paper sheets Sa and the binding processor 70, indicating positional relationships between them when conducting various kinds of bind processing. FIG. 5(*a*) shows a plan view indicating a side staple processing in which stapling needles SP are stapled onto two positions located at the side end portion of the bunch of paper sheets Sa and being symmetrical with respect to the center line, while FIG. 5(*b*) shows a plan view indicating a corner staple processing in which a stapling needle SP is stapled onto a single position located at a corner end portion of the bunch of paper sheets Sa. Although a first stapler 70A and a second stapler 70B conduct the staple processing in such the modes as indicated in FIG. 5(*a*) and FIG. 5(*b*), the stapling positions are changed corresponding to the size of the paper sheet concerned.

#(Driving Mechanical System of Bind Processing Section)

Figure 6:
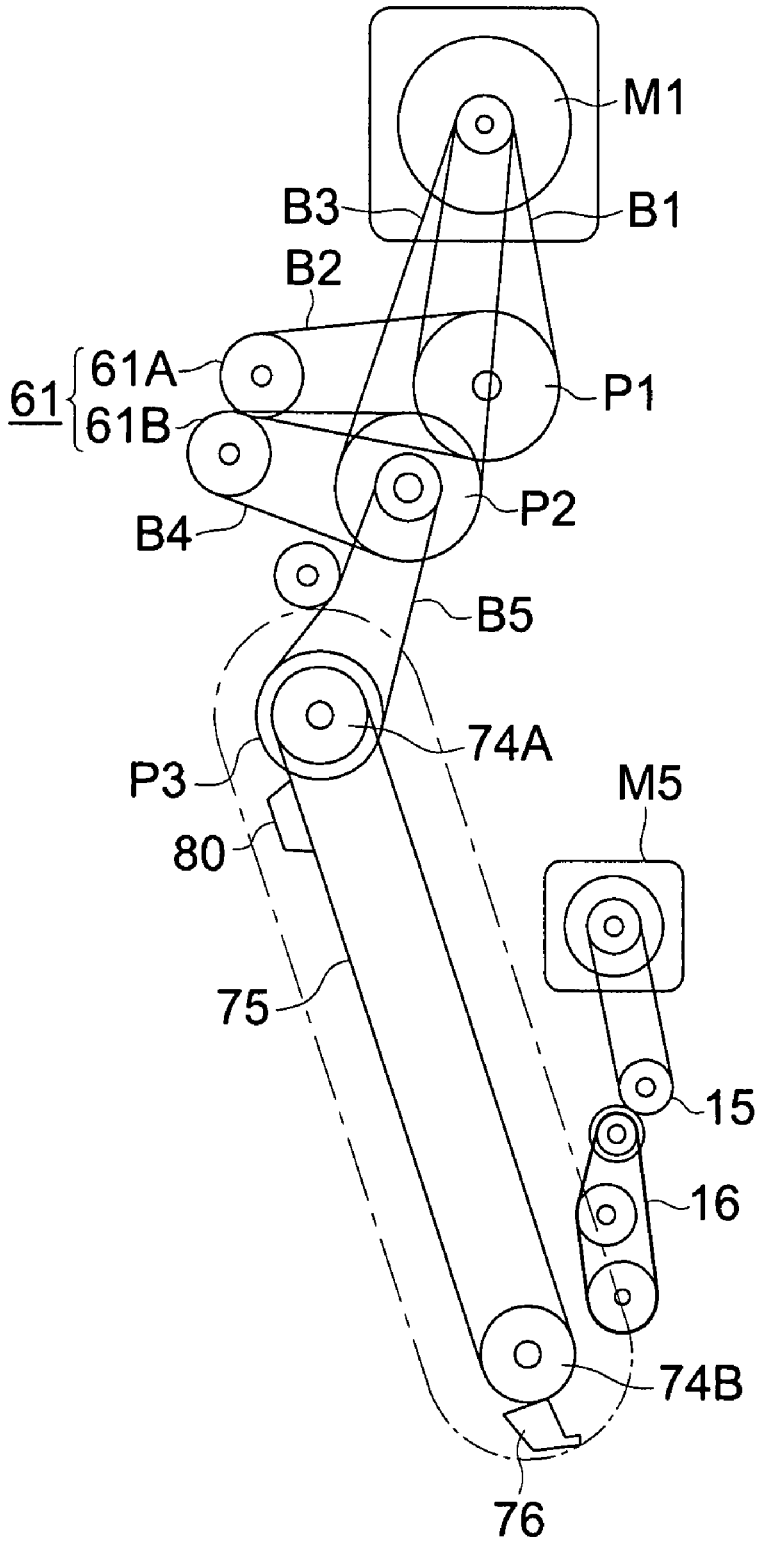
FIG. 6 shows schematic diagram of a configuration of a driving mechanical system.
Figure 7:
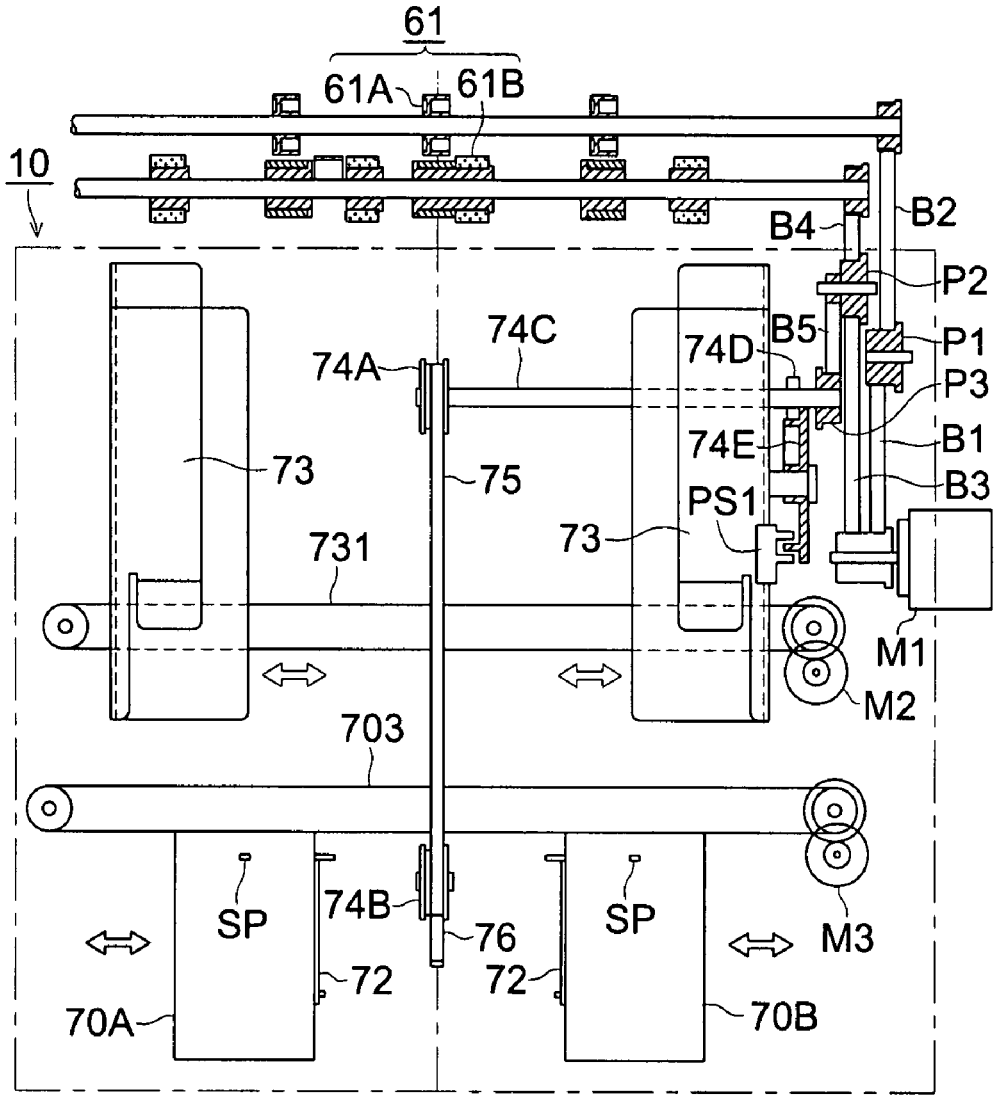
FIG. 7 shows a plan view of a paper sheet stacking apparatus.

FIG. 6 shows schematic diagram of a configuration of the driving mechanical system for driving the circulating action of the ejecting belt 75 and the swinging action of the pair of ejecting rollers 61, while FIG. 7 shows a plan view of the paper sheet stacking apparatus.

A first motor M1 drives an upper roller 61A of the pair of ejecting rollers 61 to rotate, through a belt B1, a pulley P1 and a belt B2, and at the same time, also drives a lower roller 61B of the pair of ejecting rollers 61 to rotate, through a belt B3, a pulley P2 and a belt B4. Further, the first motor M1 drives the driving pulley 74A to rotate, through the belt B3, the pulley P2, a belt B5 and a pulley P3, so as to drive the ejecting belt 75, serving as a single belt, to circulate and move.

A gear 74D, fixed onto an axial end portion of a rotating shaft 74C of the driving pulley 74A, mates with a cam member 74E to rotate the cam member 74E. The cam member 74E is provided with an actuator. A sensor PS1 detects the actuator, in order to establish the standby position of the ejecting nail 76 fixed onto the ejecting belt 75 at the time when the ejecting belt 75 is deactivated.

A second motor M2 drives the pair of width truing members 73 located upstream through a belt 731, so as to move the pair of width truing members 73 corresponding to the width of the paper sheet concerned. A third motor M3 drives both the first stapler 70A and the second stapler 70B through a belt 703, so as to set the first stapler 70A and the second stapler 70B at respective stapling positions by moving them in parallel and by rotationally moving them.

As shown in FIG. 6, a firth motor M5 drives the pair of conveyance rollers 15 to rotate, and at the same time, also drives the wind up belt 16 to circulate.

#(Conveyance Operation for Bunch of Paper Sheets After Completion of Bind Processing)

Figure 8:
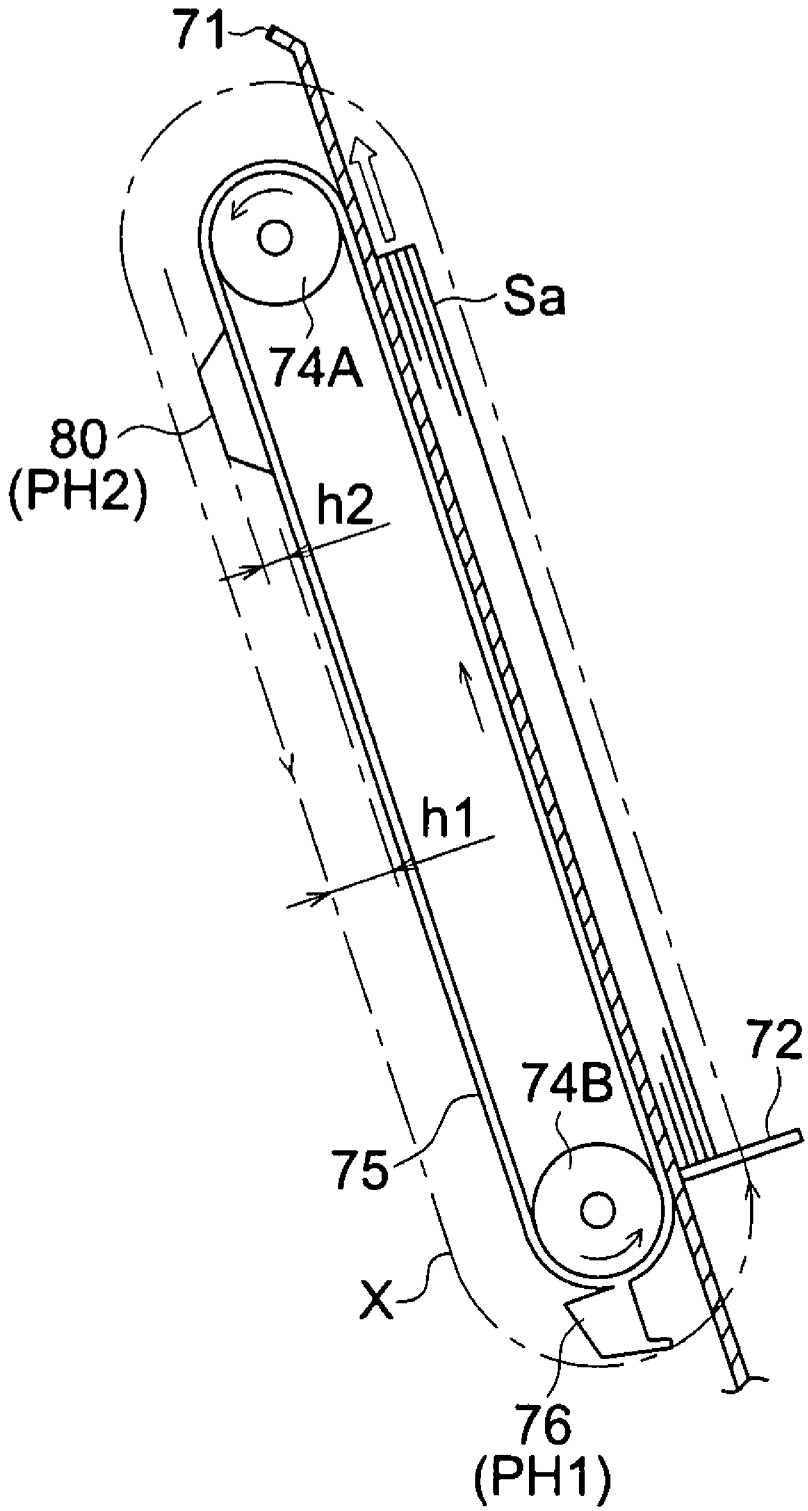
FIG. 8 shows a cross sectional view of a configuration in the vicinity of an ejecting belt, indicating a state just before a bunch of paper sheets, for which an end bind processing is completed, is ejected.

FIG. 8 shows a cross sectional view of the configuration in the vicinity of the ejecting belt 75, indicating a state just before the bunch of paper sheets Sa, for which the end bind processing is completed, is ejected.

The trailing edge portion (or the lower end portion) of the bunch of paper sheets Sa, which is positioned and stacked on the paper sheet stacking tray 71, is held by the ejecting nail 76 fixed onto the ejecting belt 75, which is driven in a normal rotating direction by the first motor M1 having a reversible rotating capability as shown in FIG. 6, and is pushed up in the inclined upper direction indicated by the white-space arrow, so that the bunch of paper sheets Sa progresses from the position in the state shown in FIG. 8 toward the pair of ejecting rollers 61, and is ejected onto the paper sheet ejecting elevation tray 91.

Since a standby position PH1 of the ejecting nail 76 at the time of the end bind processing is set at the lower position of the paper sheet stacking tray 71, it becomes possible for the ejecting nail 76 to swiftly move to the push-up position at which the ejecting nail 76 pushes up the trailing edge portion of the bunch of paper sheets Sa in response to the paper sheet ejecting signal.

The ejecting belt 75 is a timing belt having a gear teeth profile and is shaped in an endless-belt. The ejecting nail 76 is integrally formed on a part of the outer circumferential surface of the ejecting belt 75. The width of the ejecting belt 75 and the ejecting nail 76, made of the urethane rubber, is set at, for instance, 6 mm. It is an advantage of the ejecting nail 76 made of the urethane rubber that, when the ejecting nail 76 abrasively contacts the trailing edge portion of the bunch of paper sheets Sa, a smaller amount of abrasive scars are generated, compared to the ejecting nail made of the conventionally employed material, such as a chloroprene rubber (CR), etc.

Concretely speaking, when the ejecting nail 76 moves along the upper surface of the paper sheet stacking tray 71 while abrasively contacting the trailing edge portion of the bunch of paper sheets Sa, and is turned out of the upper surface of the paper sheet stacking tray 71, little amount of abrasive scars are generated when the ejecting nail 76 moves while abrasively contacting the rear surface of the bunch of paper sheets Sa.

FIG. 9(*a*) and FIG. 9(*b*) show partial cross sectional views for explaining the operation of the ejecting nail 76. FIG. 9(*a*) indicates a state of the ejecting belt 75 before the bunch of paper sheets Sa is ejected, while FIG. 9(*b*) indicates a state that the bunch of paper sheets Sa is currently ejected by the ejecting belt 75.

The ejecting nail 76, integrally formed on a part of the outer circumferential surface of the ejecting belt 75, is constituted by the a paper sheet butting surface 76A, an upper end regulating section 76B, a connecting section 76C, a reinforcing section 76D, a slit section (notch section) 76E, an inclined surface section 76F, etc.

The paper sheet butting surface 76A pushes the trailing edge portion of the bunch of paper sheets Sa so as to convey the bunch of paper sheets Sa to the ejecting section 60. The upper end regulating section 76B regulates the curling defect, which is liable to occur at the upper surface of the trailing edge portion of the bunch of paper sheets Sa.

The connecting section 76C serves as a joining part for joining the connecting section 76C to the outer circumferential surface of the ejecting belt 75, and is integrally formed on a part of the ejecting belt 75 including at least a gear tooth 75A as a meaty shape. The connecting section 76C formed in a meaty shape has such a strength that is sufficient for pushing up the trailing edge portion of the bunch of paper sheets Sa, in order to convey and eject the bunch of paper sheets Sa. Further, the length of the connecting section 76C is set at such a minimum length that its bending is as small as possible when the ejecting belt 75 circulates on the driving pulley 74A and the driven pulley 74B.

The reinforcing section 76D is a portion, which is made to be meaty in order to reinforce the back portion of the paper sheet butting surface 76A, and has a sufficient strength, so as not to generate a deformation to be caused by the pushing pressure when the ejecting nail 76 pushes up the trailing edge portion of the bunch of paper sheets Sa in order to convey and eject the bunch of paper sheets Sa.

The slit section 76E is formed between the bottom section of the reinforcing section 76D and the plan section of the outer circumferential surface of the ejecting belt 75. The slit width of the slit section 76E is set at a narrow gap of, for instance, 0.5 mm, so that, when the paper sheet butting surface 76A of the ejecting nail 76 press-pushes the bunch of paper sheets Sa, the bottom section of the reinforcing section 76D is press-pushed onto the plan section of the outer circumferential surface of the ejecting belt 75, in order to prevent the ejecting nail 76 form falling down.

Since a plurality of gear teeth 75B exist below the plan section of the outer circumferential surface of the ejecting belt 75 within the bottom section of the slit section 76E, corresponding to the bottom section of the reinforcing section 76D, the plurality of gear teeth 75B serves as reinforcing members when the ejecting nail 76 is press-pushed.

Figure 10:
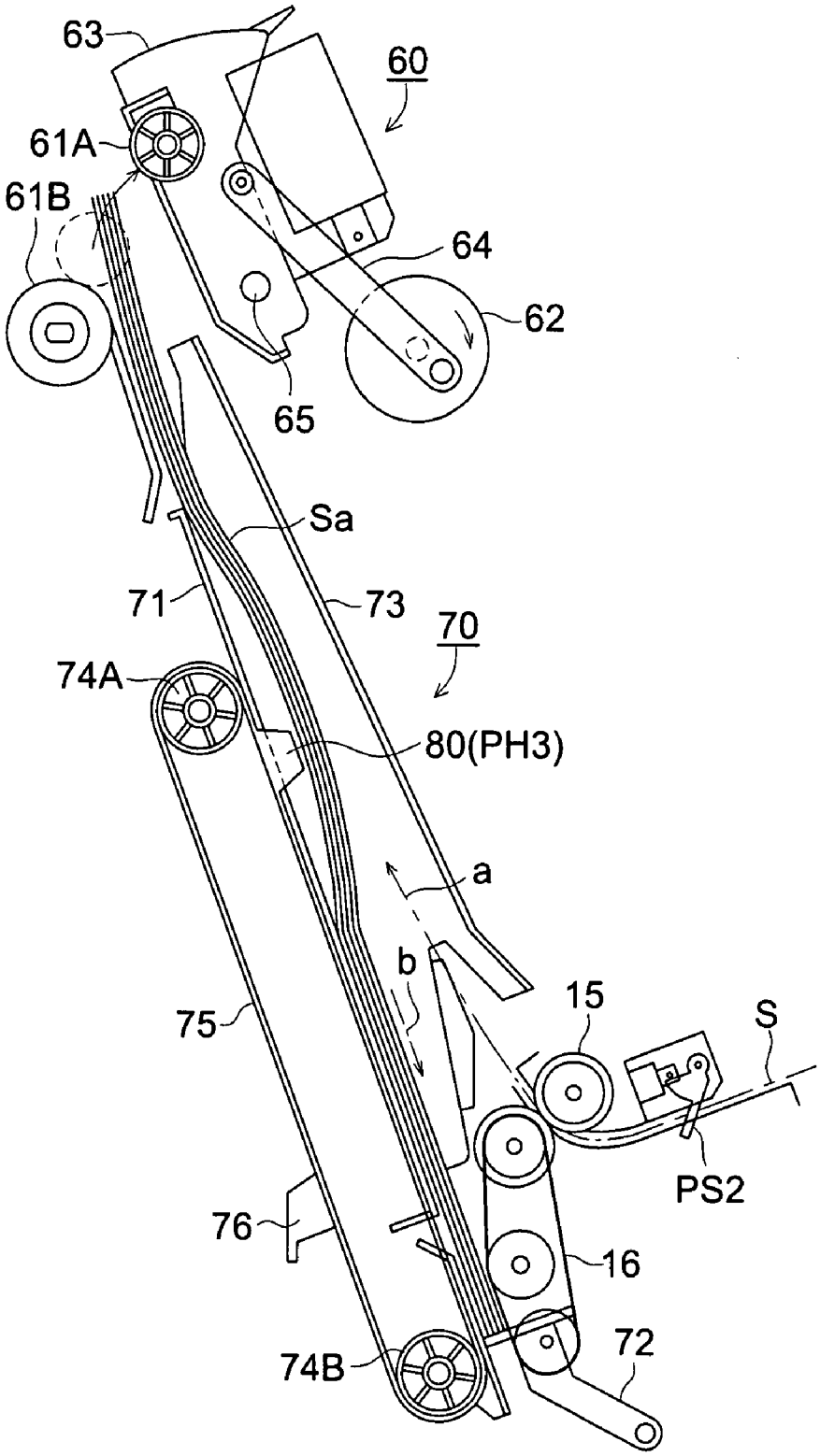
FIG. 10 shows a cross sectional view of a binding processor and other peripheral mechanisms.

FIG. 10 shows a cross sectional view of the binding processor 70 and other peripheral mechanisms, indicating a state of ejecting and stacking the paper sheet S onto the paper sheet stacking tray 71.

The paper sheet S, which is tightly clipped and conveyed to the paper sheet stacking tray 71 by the pair of conveyance rollers 15, is further conveyed into the upper space of the paper sheet stacking tray 71, so that the paper sheet S elevates toward its upper portion. After the trailing edge portion of the paper sheet S has completely passed through the clipping position of the pair of conveyance rollers 15, the paper sheet S begins to descend (slip down) along the inclined surface of the paper sheet stacking tray 71 due to its own weight, and after traveling on the inclined surface, the paper sheet S stops by butting its trailing edge against the paper sheet butting surface of the butting member 72, and is trued.

Figure 13:
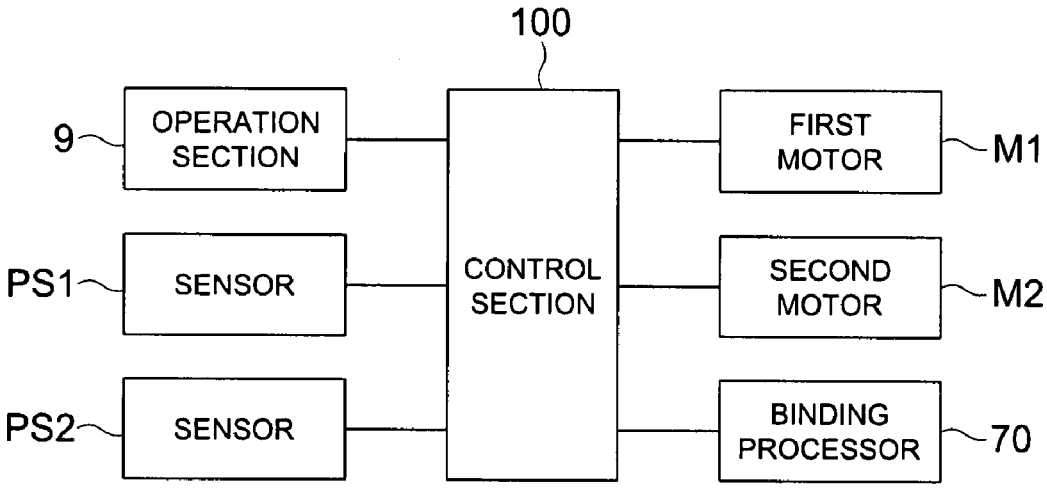
FIG. 13 shows a block diagram of a controlling system of the paper sheet post processing apparatus.

The setting signals for setting post processing items, a size of paper sheet, a kind of paper sheet, a number of paper sheets, etc., are inputted into a control section 100, shown in FIG. 13, by operating the operation section 9 of the image forming apparatus proper A, shown in FIG. 2.

When the end bind processing (refer to FIG. 5(*a*) and FIG. 5(*b*)) for a large-sized paper sheet S (for instance, an A3 size paper sheet, a B4 size paper sheet, a paper sheet of 85×14 inch size) is established from the operation section 9, a driving motor (not shown in the drawings) equipped in the ejecting section 60 commences to rotate, so as to make a circular plate 62 rotate through a driving power transmission device, such as a gear train, etc. The eccentricity position of the circular plate 62 is coupled to an upper roller unit 63 by a crank arm 64. According as the circular plate 62 rotates, the crank arm 64 exhibits a swinging action, so as to make the upper roller unit 63 swing around a supporting shaft 65, serving as a center of the swinging action. Accordingly, the upper roller 61A supported by the upper roller unit 63 moves upward from the tightly clipping position with the lower roller 61B, so as to open the paper sheet path.

In the state that the paper sheet path is opened by the abovementioned actions, the large-sized paper sheet S is tightly clipped and conveyed by the pair of conveyance rollers 15, so as to progress in a direction indicated by the alternate long and short dash line shown in FIG. 10. Then, the large-sized paper sheet S elevates in an upper space of a paper sheet stacking tray 71, and the leading edge of the large-sized paper sheet S arrives at a gap as the open space created between the upper roller 61A and the lower roller 61B.

After the trailing edge portion of the large-sized paper sheet S has completely passed through the clipping position of the pair of conveyance rollers 15, the large-sized paper sheet S slips on the upper surface of the paper sheet stacking tray 71 in a conveyance direction b shown in FIG. 10 due to its own weight, and after traveling on the inclined surface, the paper sheet S stops by butting its trailing edge against the paper sheet butting surface of the butting member 72, and is trued.

In the same way as mentioned in the above, other large-sized paper sheets S, successive conveyed into the binding processor 70, are also trued and stacked on the paper sheet stacking tray 71.

Based on detecting results of the large-sized paper sheets S detected by a sensor PS2 disposed at a upstream side of the pair of conveyance rollers 15, the control section 100 counts a number of the large-sized paper sheets S conveyed into the paper sheet stacking tray 71, so that a predetermined number of the large-sized paper sheets S, set in advance, are stacked on the paper sheet stacking tray 71.

When the control section 100 determines that the predetermined number of the large-sized paper sheets S (for instance, 10 paper sheets) are stacked on the paper sheet stacking tray 71 during the abovementioned stacking process, the control section 100 drives the first motor M1 to rotate in a reverse direction, and as a result, the ejecting belt 75 is driven to rotate in a clockwise direction through the driving member, in order to move the protrusion member 80 from a standby position PH2 shown in FIG. 8 to a push-up position PH3, which is protruded form the paper sheet stacking surface of the paper sheet stacking tray 71 as shown in FIG. 10 and at which the control section 100 stops the movement of the protrusion member 80. The stop position of the protrusion member 80 is set at such a position that is located above the paper sheet butting surface of the butting member 72 and the distance between them is ½ of the long side of the B4 size paper sheet, namely, a half of the length in the conveyance direction.

As mentioned in the above, since the protrusion member 80 moves to the push-up position PH3 after a plurality of paper sheets S are stacked on the paper sheet stacking tray 71, it is preferable that the upper surface of the protrusion member 80 is finished with such a material that has a good slipperiness property. In the present embodiment, the protrusion member 80 is made of a urethane rubber and is coated with a PET (Polyethylene Terephthalate) film by adhering it on the urethane rubber.

As described in the foregoing, the protrusion member 80 is set at the push-up position PH3 shown in FIG. 10, so as to push up the bunch of paper sheets Sa. As a result of floating up the center portion of the bunch of paper sheets Sa, the leading edge of the bunch of paper sheets Sa contacts the paper sheet stacking tray 71. This prevents the leading edge of the bunch of paper sheets Sa from floating up.

A relationship between a height h1 of the ejecting nail 76 and a height h2 of the protrusion member 80 is indicated in FIG. 8.

The ejecting nail 76 is formed in such a dimension that the bunch of paper sheets Sa, having 100 paper sheets at maximum, can be pushed up by its height h1, namely, for instance, the height h1 of the ejecting nail 76 is set at 22 mm. On the other hand, the protrusion member 80 is formed in such a dimension that the height h2 of the protrusion member 80 is in a range of about 4-10 mm. If the height h2 is smaller than 4 mm, the effect for correcting the posture of the paper sheet S would be lowered, while, if the height h2 is greater than 10 mm, the effect for smoothly conveying the paper sheet S would be lowered. Incidentally, both the height h1 and the height h2 are measured with reference to the paper sheet stacking surface of the paper sheet stacking tray 71.

Figure 11:
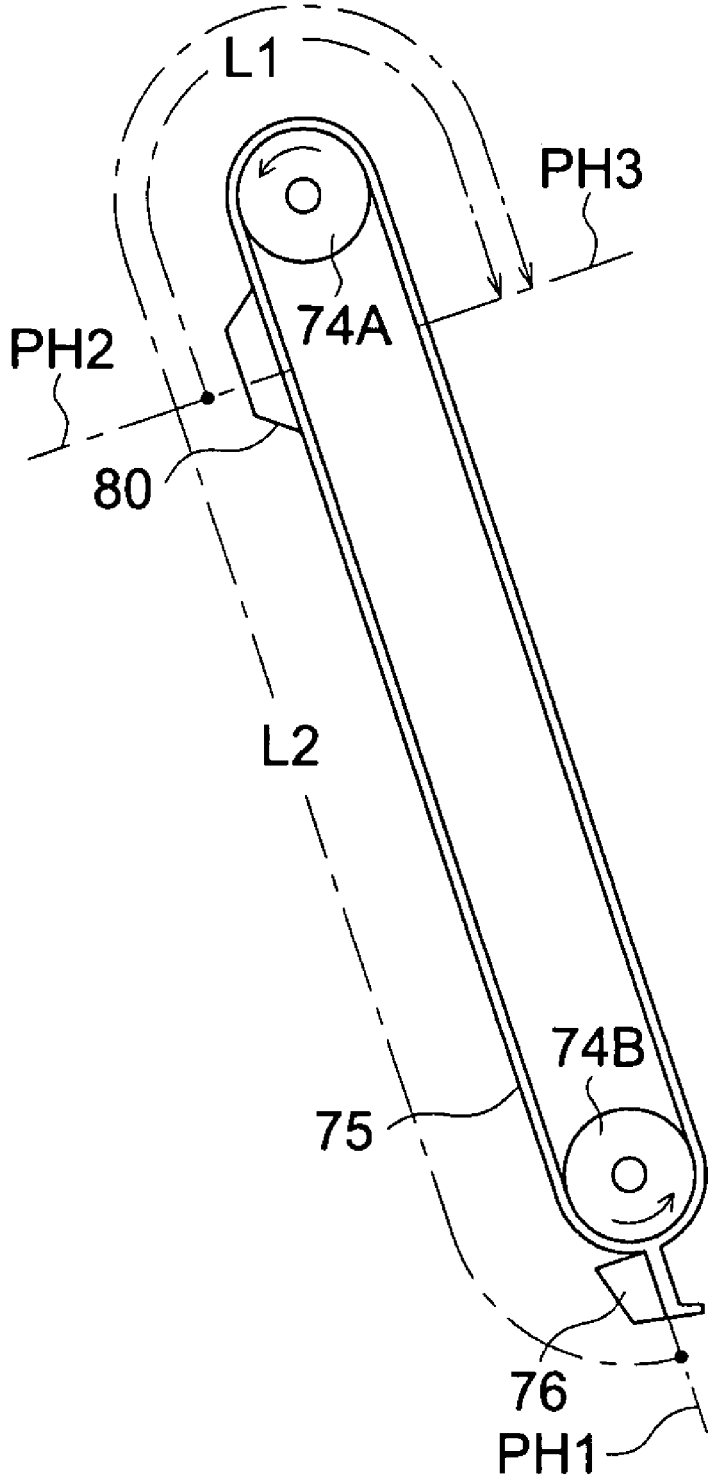
FIG. 11 shows an explanatory drawing for explaining an operation of a protrusion member.

FIG. 11 shows an explanatory drawing for explaining the operation of the protrusion member 80.

The protrusion member 80 moves a distance L1 from the standby position PH2 to the push-up position PH3 at which the protrusion member 80 is set. As set forth in Patent Document 1 (Tokkai 2003-20154, Japanese Non-Examined Patent Publication), when the ejecting nail 76 is employed for pushing up the paper sheet, it is necessary for the ejecting nail 76 to move a distance L2 from the standby position PH1 to the push-up position PH3, in order to set the ejecting nail 76 at the push-up position PH3. Assuming that the distance L2, along which the ejecting nail 76 moves from the standby position PH1 to the push-up position PH3 in a direction opposite to that at the time of ejecting the paper sheet, is defined as an imaginary moving distance, it is apparent that the distance L2 is far larger than the distance L1, namely, L1<<L2. According to the present embodiment, by making the protrusion member 80, which is formed at a position being separate from that of the ejecting nail 76, wait at the standby position PH2, it becomes possible to shorten the distance L1 from the standby position PH2 to the push-up position PH3.

By arranging the protrusion member 80 in such a manner as mentioned in the above, the time interval necessary for moving the protrusion member 80 from the standby position PH2 to the push-up position PH3 can be effectively shortened, and accordingly, it becomes possible for the operation of the protrusion member 80 to cope with the high-speed conveyance operation of the paper sheet.

Incidentally, the push-up position PH3 of the protrusion member 80 can be established at plural positions corresponding to various kinds of paper sheet sizes.

Figure 12:
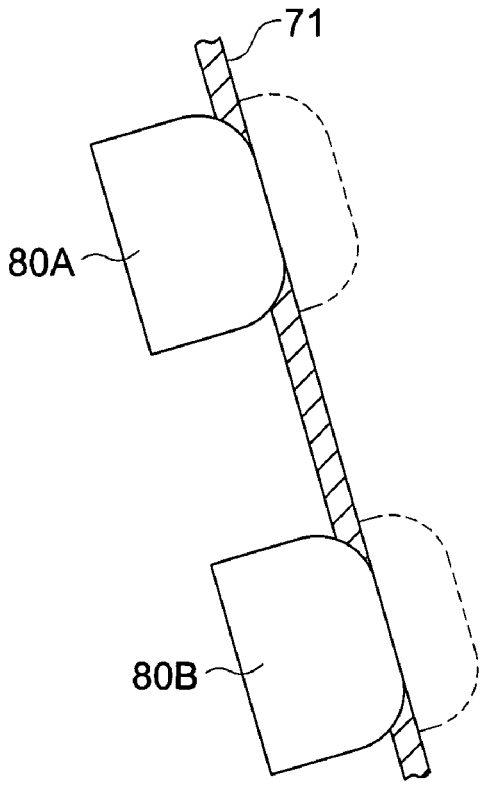
FIG. 12 shows another example of protrusion members.

Further, instead of forming the protrusion member 80 on the ejecting belt 75, a plurality of protrusion members can be equipped on plural positions residing along the paper sheet conveyance direction, as shown in FIG. 12. In this case, corresponding to the size of the paper sheet concerned, any one of protrusion members 80A, 80B is selectively protruded from the paper sheet stacking surface of the paper sheet stacking tray 71, so as to push upward the bunch of paper sheets Sa, as indicated by the broken lines shown in FIG. 12.

FIG. 13 shows a block diagram of the controlling system of the paper sheet post processing apparatus FS. Referring to FIG. 13, the operation of the paper sheet post processing apparatus FS in relation to the operations of the protrusion member 80 will be detailed in the following.

The control section 100 shown in FIG. 13 conducts the controlling operations described in the following.

Every time when the paper sheet S is conveyed onto the paper sheet stacking tray 71, the pair of width truing members 73 is driven by the second motor M2 to true the paper sheet S concerned. This paper sheet truing operation is conducted according to the timing controlling action based on the paper sheet passing signal detected by the sensor PS2.

At the time when the sensor PS2 detects a predetermined number of paper sheets, for instance, 10 paper sheets, the first motor M1 is activated to circulate the ejecting belt 75 in the clockwise direction as shown in FIG. 11, so as to move the protrusion member 80 from the standby position PH2 to the push-up position PH3.

The operations of conveying, stacking onto the paper sheet stacking tray 71 and truing the paper sheet S are conducted in the state that the protrusion member 80 is pushing up the bunch of paper sheets Sa.

At the time when the set number of paper sheets are stacked on the paper sheet stacking tray 71, the binding processor 70 is activated to conduct the bind processing of the bunch of paper sheets Sa.

After the bind processing is completed, the first motor M1 is activated to circulate the ejecting belt 75 in the anticlockwise direction, so as to move the protrusion member 80 to the standby position PH2, and at the same time, the ejecting nail 76 pushes up the bunch of paper sheets Sa to eject it onto the paper sheet ejecting elevation tray 91.

As aforementioned, the protrusion member 80 stops at the standby position PH2 on the basis of the signal detected by the sensor PS1.

By changing the push-up position PH3 corresponding to a paper sheet size, a number of paper sheets or a kind of paper sheet, it becomes possible to appropriately suppress the floating-up amount of the leading edge portion of the stacked paper sheets. The control section 100 changes the push-up position PH3 as needed, based on the information in regard to the paper sheet size, the number of paper sheets or the kind of paper sheet established from the operation section 9.

In the operation for stacking such a small-sized paper sheet as an A4 size paper sheet, a B5 size paper sheet, etc., the paper sheet stacking operation could be conducted smoothly, even without conducting the push-up operation by the protrusion member 80. Accordingly, when stacking such the small-sized paper sheet onto the paper sheet stacking tray 71, the control section 100 conducts the paper sheet stacking operation in such a state that the protrusion member 80 is kept staying at the standby position PH2.

According to the present invention, since the protrusion member, for pushing up substantially a center portion of the paper sheet in the conveyance direction of the paper sheet, is formed as a separate member being independent of the ejecting member, it becomes possible to swiftly move the protrusion member to the push-up position within a short time, at which the protrusion member pushes up the paper sheet. Accordingly, it becomes possible not only to make the paper sheet push-up action correspond to the high-speed conveyance operation, but also to appropriately set the push-up height irrespective of the size of the bunch of paper sheets to be ejected.

Accordingly, it becomes possible to provide the paper sheet post processing apparatus in which the paper sheet stacking operation can be smoothly and stably conducted during the high-speed post processing of the paper sheets.

While the preferred embodiments of the present invention have been described using specific term, such description is for illustrative purpose only, and it is to be understood that changes and variations may be made without departing from the spirit and scope of the appended claims.

What is claimed is:

1. A paper sheet stacking apparatus, comprising:

a paper sheet stacking tray inclined with respect to a horizontal line;

an ejecting member for press-pushing a lower end portion of a paper sheet stacked on the paper sheet stacking tray to eject the paper sheet outside the paper sheet stacking apparatus;

a protrusion member for pushing up substantially a center portion of the paper sheet stacked on the paper sheet stacking tray; and an ejecting belt that circulates along the paper sheet stacking tray, wherein the protrusion member is formed as a separate member independent of the ejecting member, and wherein a height of the protrusion member is lower than a height of the ejecting member, and wherein the ejecting member is fixed at a specific position on the ejecting belt and the protrusion member is fixed at another position separate from the specific position.

2. The paper sheet stacking apparatus of claim 1, wherein the protrusion member moves with a circulating action of the ejecting belt from a standby position of the protrusion member to a push-up position at which the protrusion member pushes up the paper sheet, and wherein a moving distance of the protrusion member from the standby position of the protrusion member to the push-up position is shorter than an imaginary moving distance of the ejecting member from another standby position of the ejecting member to the push-up position.

3. The paper sheet stacking apparatus of claim 2, further comprising:

a control section to change the push-up position.

4. The paper sheet stacking apparatus of claim 1, wherein the protrusion member is capable of protruding and retreating from a paper sheet stacking surface of the paper sheet stacking tray.

5. The paper sheet stacking apparatus of claim 4, further comprising:

a plurality of protrusion members arranged on the paper sheet stacking surface; and a control section for controlling the plurality of protrusion members and selectively making one of the plurality of protrusion members protrude or retreat from the paper sheet stacking surface.

6. The paper sheet stacking apparatus of clam 2, further comprising:

a control section for determining whether or not the protrusion member is made to move to the push-up position.

7. The paper sheet stacking apparatus of claim 5, wherein the control section determines whether or not the protrusion member is made to protrude from the paper sheet stacking surface.

8. A post processing apparatus, comprising:

a paper sheet stacking apparatus including a paper sheet stacking tray inclined with respect to a horizontal line; and a binding processor for applying a bind processing to a bundle of paper sheets stacked on the paper sheet stacking tray, wherein the paper sheet stacking apparatus further includes:

an ejecting member for press-pushing a lower end portion of a paper sheet stacked on the paper sheet stacking tray to eject the paper sheet outside the paper sheet stacking apparatus;

a protrusion member for pushing up substantially a center portion of the paper sheet stacked on the paper sheet stacking tray an ejecting belt that circulates along the paper sheet stacking tray, wherein the protrusion member is formed as a separate member independent of the ejecting member, and wherein a height of the protrusion member is lower than a height of the ejecting member, and wherein the ejecting member is fixed at a specific position on the electing belt and the protrusion member is fixed at another position separate from the specific position.

9. The post processing apparatus of claim 8, wherein the protrusion member moves with a circulating action of the ejecting belt from a standby position of the protrusion member to a push-up position at which the protrusion member pushes up the paper sheet, and wherein a moving distance of the protrusion member from the standby position of the protrusion member to the push-up position is shorter than an imaginary moving distance of the ejecting member from another standby position of the ejecting member to the push-up position.

10. The post processing apparatus of claim 9, wherein the paper sheet stacking apparatus further includes:

a control section to change the push-up position.

11. The post processing apparatus of claim 8, wherein the protrusion member is capable of protruding and retreating from a paper sheet stacking surface of the paper sheet stacking tray.

12. The post processing apparatus of claim 11, wherein the paper sheet stacking apparatus further includes:

a plurality of protrusion members arranged on the paper sheet stacking surface; and a control section for controlling the plurality of protrusion members and selectively making one of the plurality of protrusion members protrude or retreat from the paper sheet stacking surface.

13. The post processing apparatus of claim 9, wherein the paper sheet stacking apparatus further includes:

a control section for determining whether or not the protrusion member is made to move to the push-up position.

14. The post processing apparatus of claim 12, wherein the control section determines whether or not the protrusion member is made to protrude from the paper sheet stacking surface.

* * * * *